US006054646A

United States Patent [19]

Pal et al.

[11] Patent Number: 6,054,646

[45] Date of Patent: Apr. 25, 2000

[54] SOUND-BASED EVENT CONTROL USING TIMBRAL ANALYSIS

[75] Inventors: Christopher Pal, Cambridge, Canada; Malcolm Slaney, Los Altos Hills; Robert L. Adams, Palo Alto, both of Calif.

[73] Assignee: Interval Research Corporation, Palo Alto, Calif.

[21] Appl. No.: 09/049,041

[22] Filed: Mar. 27, 1998

[51] Int. Cl.[7] ..... G10H 7/00

[52] U.S. Cl. ..... 84/608; 84/626

[58] Field of Search ..... 84/608, 626, 645, 84/659, 662

[56] References Cited

U.S. PATENT DOCUMENTS 5,138,924 8/1992 Ohya et al. .
5,196,639 3/1993 Lee et al. .
5,412,152 5/1995 Kageyama et al. .
5,536,902 7/1996 Serra et al. .
5,621,182 4/1997 Matsumoto .
5,625,749 4/1997 Goldenthal et al. .
5,744,742 4/1998 Lindemann et al. ..... 84/626 X
5,749,073 5/1998 Slaney .
5,750,912 5/1998 Matsumoto ..... 84/609

*Primary Examiner*—Jeffrey Donels
*Attorney, Agent, or Firm*—Burns, Doane, Swecker & Mathis, L.L.P.

[57] ABSTRACT

Arbitrary input sounds are analyzed and the coefficients of a low-dimensional representation, such as LPC or MFCC, are determined as a measure of the timbre of the sounds. The coefficients can be employed in different ways to control output events, such as the generation of synthesized sounds. In one approach, the individual coefficients are mapped to the control parameters of a sound synthesizer, to enable highly complex output sounds to be generated in response to simple input sounds. In another approach, pattern recognition techniques are employed with respect to the coefficients, to classify the input sounds. Each classification is mapped to a control parameter, to cause different events to occur in response to the respective input sounds. In one example, the sounds of different musical instruments are generated in dependence upon the classification of the input sounds. These analysis techniques have low latency, and thereby allow events to be controlled without perceptible delay.

33 Claims, 2 Drawing Sheets

SOUND-BASED EVENT CONTROL USING TIMBRAL ANALYSIS

FIELD OF THE INVENTION

The present invention is directed to the control of events on the basis of input sounds, and more particularly to the control of output events, such as the generation of a synthesized sound, in accordance with the timbral analysis of an input sound.

BACKGROUND OF THE INVENTION

A variety of situations exist in which it is desirable to perform an action on the basis of sounds which may naturally occur in an ambient environment, or sounds which are specifically generated as input parameters. As an example, U.S. Pat. No. 5,536,902 discloses a system in which an output sound is synthesized in accordance with the analysis of a received input sound. That system employs a spectral modeling synthesis technique, to analyze an input sound and use the results of the analysis to generate a synthesized version of the same sound, or another sound which is related to the original input sound, e.g. one having extended or shortened duration.

It is desirable to utilize input sounds not only for the synthesis of related output sounds, but also for the control of events that are distinct from the input sounds themselves. One area of particular interest in this regard pertains to the control of synthesizers that can produce highly complex sounds. An example of such a synthesizer is the model VL-1 Virtual Tone Generator, manufactured by Yamaha Corporation. This synthesizer uses mathematical physical models of instruments to generate sounds. Although the synthesizer is capable of generating extremely realistic sounds, it is also difficult to control accurately, due to the nature of the physical model synthesis technique. In particular, the synthesizer has a number of parameters, each of which is controllable in real time to affect the sound synthesis in various ways and to different degrees. These various parameters include: Pressure, Embouchure, Pitch Bend, Vibrato, Tonguing, Amplitude, Scream, Breathe Noise, Growl, Throat Formant, Dynamic Filter, Harmonic Enhancement, Damping and Absorption. The synthesizer permits a single input controller to change any number of these synthesis parameters. In addition, the synthesis parameters can be associated with control curves, or functions, that are applied to the associated controller input parameters.

One approach for controlling a synthesizer of this type is described in a copending application of Adams et al entitled "System and Method for Controlling a Music Synthesizer". This approach maps manually generated signals, such as finger pressure on sensor devices, to input parameters that control the operation of the synthesizer. It is an objective of the present invention to utilize input sound as the basis for the parameters that control the synthesizer, rather than finger pressure or the like, because sounds offer greater dimensionality and dynamic range than many types of manually generated signals.

In the past, the analysis of sounds to determine control parameters has been principally based upon the pitch of the input sound. In essence, pitch is a measure of the periodicity of a sound. For low frequency sounds, therefore, a relatively large number of input samples must be taken to determine the pitch. This requirement means there is a natural latency in the analysis of the sound. Due to delays which may be inherent in such an approach, the control of the desired output event is not immediately responsive to the input data, from a perceptual standpoint. For instance, there may be gaps in a synthesized output sound until enough input data is obtained to determine the pitch. This phenomenon is evident, for instance, in cases where the input sound that is used to control an event is a speaker's voice.

Accordingly, it is an objective of the present invention to provide a technique for analyzing sounds to determine parameters other than pitch which enable the analysis to be accomplished more quickly, and thereby provide responsive control of output events. In particular, it is an objective to provide a technique that provides for perceptually immediate response to voice-based input controls.

SUMMARY OF THE INVENTION

In accordance with the present invention, the foregoing objectives are achieved by measuring the timbre of an input sound. The analysis of an arbitrary input sound's timbre can be employed to trigger desired output events, using pattern recognition techniques. Alternatively, continuous parameters of the timbral analysis of an input sound can be associated with parameters of output sound, so that the qualities of the input sound can be used to modify synthesized timbre in real-time. This approach provides convenient control of a physical model based synthesizer, where numerous input parameters must be adjusted in real-time in order to create pleasing sounds.

In a preferred embodiment of the invention, the timbral analysis of a sound is accomplished by determining a low-dimensional representation for the sound, such as its mel-frequency cepstral coefficients. To this end, an analog input signal is first encoded into frames of digital data, and a Fourier transform is computed for each frame, to determine its spectral content. This spectrogram of the sound is then processed to determine its mel-frequency cepstral coefficients. Generally speaking, the coefficients define the characteristics of a filter bank which provides an auditory model that represents the input sound.

The coefficients which are determined for each input sound can be used in a variety of different ways to control output events. In one embodiment of the invention, a number of the coefficients can be mapped to the control parameters of a sound synthesizer. Typically, a number of the lowest-frequency filter coefficients are of most interest, and each of these coefficients can be mapped to a different control parameter of the synthesizer, either directly or via transforms. As a result, highly complex output sounds can be generated in response to relatively simple input sounds.

In another embodiment of the invention, the coefficients of the low-dimensional representation can be employed to classify input sounds. For example, two or more of coefficients can be plotted against one another, to define a multi-dimensional space. Different regions of this space can be associated with different classes of input sounds. When an arbitrary input sound is received, its coefficients determine a vector within the multi-dimensional space, which can then be used to classify the input sound. A particular synthesized sound can be associated with each class of input sound. Thus, as each arbitrary input sound is classified, the corresponding synthesized sound, which can be significantly more complex, is generated in response thereto.

Further features of the invention, and the advantages attained thereby, are explained in greater detail hereinafter with reference to specific embodiments illustrated in the accompanying drawings.

DETAILED DESCRIPTION

To facilitate an understanding of the present invention, it is described hereinafter with specific reference to an embodiment in which input sounds are analyzed to control a complex synthesizer. It will be appreciated, however, that the principles which underlie the invention are not limited to his particular implementation. Rather, the timbral analysis of a sound that is conducted in accordance with the invention can be used to control a variety of different types of arbitrary events, in addition to, or in lieu of, the synthesis of output sounds.

Figure 1:
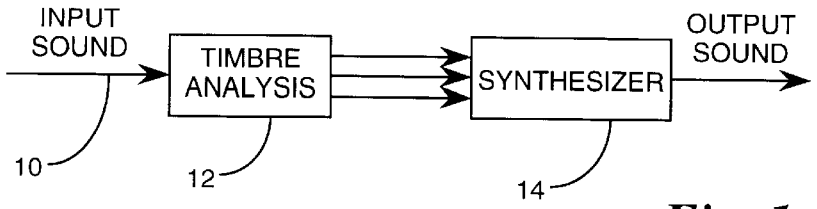
FIG. 1 is a general block diagram of a sound analysis and generation system in accordance with the invention.

Referring to FIG. 1, one embodiment of the present invention is illustrated in general block diagram form. An arbitrary input sound 10 is presented to an analyzer 12 by a microphone, or the like. The input sound could be, for example, words or other speech-related sounds spoken by a person, non-vocal sounds such as the noise produced by banging two objects together, or naturally occurring sounds which are heard in the ambient environment. The analyzer 12 can be, for example, a general purpose computer which is suitably programmed to carry out the steps of the analysis described in detail hereinafter. Within the analyzer 12, the timbre of the input sound is measured. Generally speaking, the "timbre" of a sound is considered to be all of those components which characterize a sound, other than its pitch and loudness. For a more detailed discussion of timbre, reference is made to Wessel, "Timbre Space as a Musical Control Structure", *Computer Music Journal*, Vol. 3, No. 2, pp. 45–52, incorporated by reference herein. The measurement of the sound's timbre results in a number of values that can be used as control parameters. These control parameters are applied to a synthesizer 14, to cause the synthesizer to generate a particular output sound that may be entirely different from the original input sound.

Figure 2:
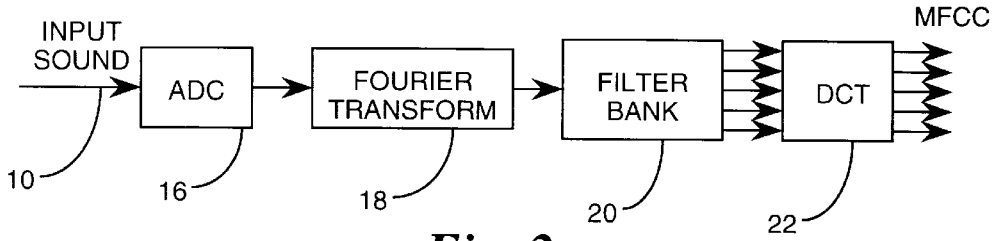
FIG. 2 is a more detailed block diagram of the analysis of a sound to determine its MFCC.

The measurement of a sound's timbre in accordance with the present invention is determined from a low-dimensional representation of the sound. In one embodiment of the present invention, the timbral analysis of the input sound 10 is carried out by determining its mel-frequency cepstral coefficients (MFCC). A detailed explanation of the procedure for calculating the MFCC representation of a sound can be found in Hunt et al, "Experiments in Syllable-Based Recognition of Continuous speech", *Proceedings of the* 1980 *ICASSP*, Denver, Colo., pages 880–883, the disclosure of which is incorporated herein by reference. In general, the MFCC representation of a sound is computed by sampling its magnitude spectrum to match critical bands that are related to auditory perception. Referring to FIG. 2, the process which is undertaken in the analyzer 12 is illustrated in greater detail. An analog input sound is first converted in an analog-to-digital converter 16, to produce frames of digital data. Each frame might comprise, for example, 20–40 milliseconds of the input sound. A Fourier transform 18 is computed for each frame to produce a spectrogram. Various channels of the spectrogram are then combined to produce a filter bank 20, which forms an auditory model that approximates the characteristics of the human ear. The filter bank produces a number of output signals, e.g. 40 signals, which undergo a logarithmic compression and a Discrete Cosine Transform (DCT) 22 to rearrange the data values. A predetermined number of the lowest frequency components, e.g. the thirteen lowest DCT coefficients, are then selected, to provide the MFCC representation of the sound. These coefficients define a space where the Euclidian distance between vectors provides a good measure of how close two sounds are to one another.

Other means of determining a low-dimensional representation of sound which separates the pitch information from other attributes of the sound, such as Linear Predictive Coding (LPC), can also be used. A detailed explanation of this analysis technique can be found, for example, in Rabiner et al, *Digital Processing of Speech Signals*, Prentice Hall Press, 1978, particularly at Chapter 8, the disclosure of which is incorporated herein by reference. This coding technique also results in a set of coefficients that can be used to classify or otherwise characterize the timbre of the sound.

The results of the timbral analysis, namely the values for the representative coefficients, can be used in a variety of manners to control different events. One such application is the control of a music synthesizer, particularly one which is capable of generating relatively complex sounds. As discussed previously, one example of such a synthesizer is the VL-1 Virtual Tone Generator. This synthesizer has a number of controllable parameters that can be adjusted to produce a variety of different sounds.

Figure 3:
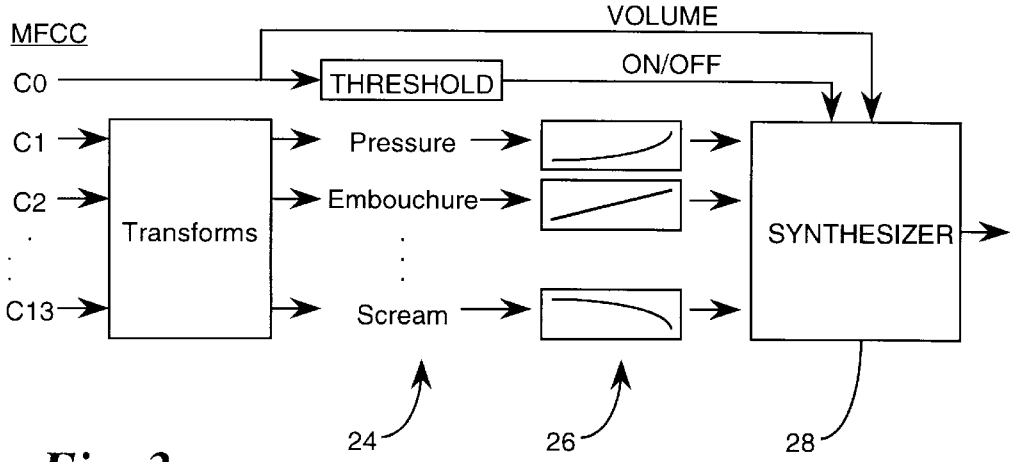
FIG. 3 is a block diagram of one embodiment of the invention which provides continuous control mappings.
Figure 4A:
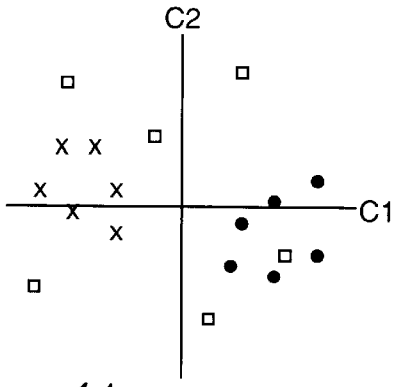
FIG. 4A–4D are exemplary plots of coefficients that define classification spaces.
Figure 4B:
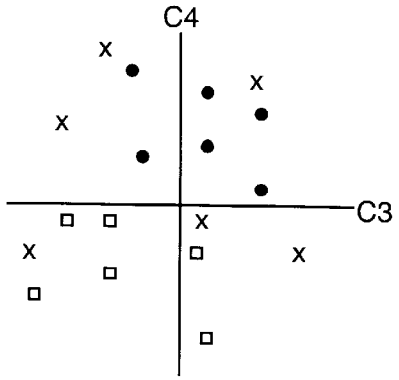
Figure 4C:
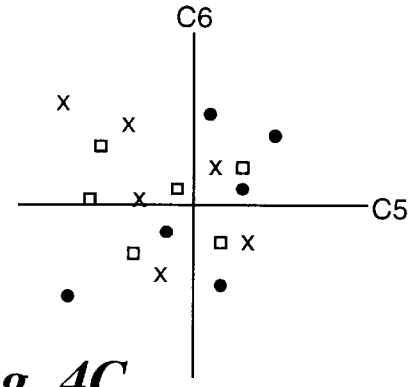
Figure 4D:
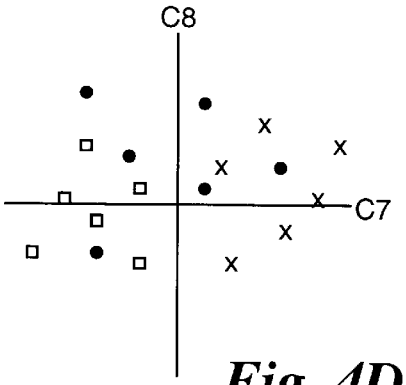

In one application of the invention, the coefficients of the low-dimensional representation can be mapped to respective control parameters for the music synthesizer. As a first step it may be preferable to scale the coefficients so that they lie within a predetermined range. For example, all of the coefficients can be proportionately scaled to lie within a range of ±128. The first coefficient of the MFCC, CO, is a measure of the energy in the original input sound. The value of this coefficient can therefore be used to detect the beginning of a sound, and thereby initiate the generation of output sounds by the synthesizer. Referring to FIG. 3, the value for the first coefficient CO is compared against a threshold value, and when the value of the coefficient exceeds the threshold, a "note on" signal is sent to the synthesizer 14. As long as the value for the first coefficient CO remains above the threshold, the synthesizer continues to play a note which is defined by the values for the control parameters. Once the CO coefficient crosses the threshold, its magnitude can be used to further control the volume of the synthesized sound.

The other coefficients of the MFCC, e.g. C1–C13, can be mapped to various control parameters for the synthesizer. In one embodiment, each coefficient might be directly mapped to a corresponding control parameter. More preferably, however, transformations are used to map a set of coefficients to a set of control parameters. For example, the sum of two coefficients, C1+C2, might be mapped to one parameter, and their difference, C1−C2, mapped to another. In general, a variety of different transforms can be employed to produce various effects.

In practice, the coefficients are preferably mapped to parameters which conform to the musical instrument digital interface (MIDI) standard, or other such standard for communicating musical information in a digital format. The MIDI data corresponding to the measured values for the coefficients is then applied to a respective control parameter 24 for the synthesizer. Each of the control parameters may have an associated function 26 that maps it to the physical model being emulated. The output values from these functions are used by the synthesizer 28 to generate audible sounds. Using this approach, therefore, highly complex synthesized sounds can be generated in response to relatively simple input sounds. For example, by voicing various vowel sounds in a continuous manner, a user can cause the synthesizer to produce a range of rich and varied output sounds.

In another application, the principles of the present invention can be employed to classify input sounds, for event control purposes. In this embodiment, the various coefficients of the low-dimensional representation are used to define one or more multi-dimensional classification spaces. FIGS. 4A–4D illustrate an example in which pairs of coefficients are plotted against one another to define four two-dimensional classification spaces. In this example, the coefficient C1 is plotted against the coefficient C2 to define one space. The other three spaces are defined by the coefficient pairs C3-C4, C5-C6 and C7-C8. Sample input sounds can then be analyzed, and a resulting value for their coefficients plotted, to define classification regions. FIGS. 4A–4D illustrate an example in which multiple samples of three different input sounds are plotted within the various two-dimensional spaces. These three input sounds could be, for example, the noises that are produced when three different objects are banged against a surface. The three objects could be of similar type, for instance, three wooden sticks of different thickness and/or composition. Alternatively, the three objects could be quite diverse from one another.

In the illustrated example, the plotted values for the three different objects are respectively represented by the "x", circle and square symbols. As can be seen, the plotted values for each of the sounds provided by the three respective objects can be used to define regions which are used to classify each input sound. Thus, for example, in the C1 versus C2 space of FIG. 4A, the region for the sound represented by the symbol "x" can be readily distinguished from the sound represented by the circle symbol. In this particular space, the sound represented by the square symbol is not easily distinguished from the other two sounds. However, the plots appearing in the other spaces, shown in FIGS. 4B–4D, enable the sound represented by the square symbol to be distinguished from the other two sounds. Thus, on the basis of the information provided by these plots, an unknown input sound can be classified into one of three defined sound categories.

Figure 5:
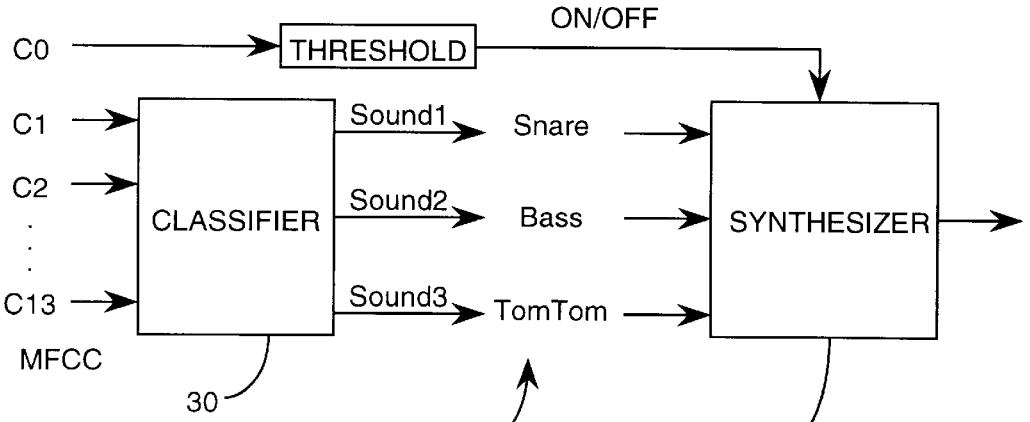
FIG. 5 is a block diagram of another embodiment of the invention which employs pattern recognition to control output events.

Each of the classes of input sounds can be mapped to a different output sound from the synthesizer. Referring to FIG. 5, the values of the coefficients for the MFCC of an unknown input sound are applied to any suitable conventional pattern classifier 30, which operates on the basis of the classification principle described above. Examples of suitable pattern classifiers are described in detail, for example, in Duda and Hart, *Pattern Classification and Scene Analysis*, John Wiley & Sons, 1973. For a given set of input values, the classifier produces an output signal which indicates which one of the recognized classes of sounds, e.g. sound 1, sound 2 or sound 3, the input sound is closest to. Each of these recognized classes can be mapped to a particular note or musical instrument 32. For example, the three sound classifications can be respectively mapped to a snare drum, a bass drum and a tom-tom drum. The output from the classifier is used to generate a MIDI value that identifies the associated instrument. As in the previous example, it is preferable to employ the value of the first coefficient, C0, to control the synthesizer 28 so that the output sound is generated only when the energy of the input sound exceeds a threshold value. In the illustrated embodiment, therefore, it is possible for a user to generate the sounds of a variety of different drums by simply banging different objects against a surface.

In the foregoing description of various embodiments of the invention, the timbral analysis of an input sound is used to control the synthesis of unrelated output sounds. It will be appreciated, however, that the practical applications of the invention are not limited to the generation of output sounds. Rather, it is feasible to map the coefficients of the low-dimensional representation to any of a number of parameters that can be employed to control a variety of different types of events on the basis of received input sounds. As illustrated by the foregoing examples, the control can be carried out in a continuous fashion, or input sounds can be classified to provide control over discrete output events. In either case, since the timbral analysis of the input sound requires very few input samples, the processing delays are minimal, thereby providing a control mechanism having perceptually immediate response.

It will be appreciated by those of ordinary skill in the art that the present invention can be embodied in other specific forms without departing from the spirit or essential characteristics thereof. The presently disclosed embodiments are therefore considered in all respects to be illustrative, and not restrictive. The scope of the invention as indicated by the appended claims, rather than the foregoing description, and all changes that come within the meaning and range of equivalence thereof are intended to be embraced therein.

What is claimed is:

1. A method for generating synthesized sounds that correspond to input sounds, comprising the steps of:

analyzing an input sound to determine coefficients for a low dimensional representation of the input sound;

mapping coefficients of said representation to control parameters that relate to the synthesis of sounds; and generating a synthesized sound in accordance with the control parameters to which the coefficients have been mapped.

2. The method of claim 1 wherein said control parameters are MIDI control parameters.

3. The method of claim 2 wherein said MIDI control parameters are selected from the group comprising pressure, embouchure, pitch, vibrato, tonguing, amplitude, breath noise and harmonic enhancement.

4. The method of claim 1 wherein one of said coefficients is a measure of the energy in the input sound, and said generating step is performed when said one coefficient is at least equal to a predetermined threshold value.

5. The method of claim 1 wherein said mapping step comprises the steps of:

defining at least one multi-dimensional space that is related to two or more of said coefficients;

defining different classes of sounds that are respectively associated with different regions of said space;

determining the location of said input sound within said space, in accordance with the determined coefficients; and classifying said input sound based upon its determined location.

6. The method of claim 5 wherein each defined class of sound has a corresponding synthesized sound to which it is mapped, and said generating step comprises the synthesis of the sound which corresponds to the classification of the input sound.

7. The method of claim 6 wherein said low-dimensional representation comprises the mel-frequency cepstral coefficients of the sound.

8. A method for generating synthesized sounds that correspond to input sounds, comprising the steps of:

analyzing an input sound to determine coefficients for a low-dimensional representation of the input sound;

defining classes of input sounds, and associating a synthesized sound with each defined class;

classifying the analyzed input sound on the basis of its determined coefficients; and generating the synthesized sound that is associated with the classification of the analyzed input sound.

9. The method of claim 8 wherein said low-dimensional representation comprises the mel-frequency cepstral coefficients of the sound.

10. The method of claim 8 wherein one of said coefficients is a measure of the energy in the input sound, and said generating step is performed when said one coefficient is at least equal to a predetermined threshold value.

11. A method for controlling an event in accordance with input sounds, comprising the steps of:

analyzing an input sound to determine a low-dimensional representation of the input sound;

mapping coefficients which characterize said representation to parameters that relate to a controllable event; and controlling said event in accordance with the parameters to which the coefficients have been mapped.

12. The method of claim 11 wherein said controllable event is the generation of a synthesized sound.

13. The method of claim 11 wherein one of said coefficients is a measure of the energy in the input sound, and further including the step of triggering said event to occur when said one coefficient is at least equal to a predetermined threshold value.

14. The method of claim 11 wherein said low-dimensional representation comprises the mel-frequency cepstral coefficients of the sound.

15. A method for controlling an event in accordance with input sounds, comprising the steps of:

analyzing an input sound to determine coefficients of a low-dimensional representation of the input sound;

defining classes of input sounds, and associating an event parameter with each defined class;

classifying the analyzed input sound on the basis of its determined coefficients; and controlling an event in accordance with the parameter that is associated with the classification of the analyzed input sound.

16. The method of claim 15 wherein said low-dimensional representation comprises the mel-frequency cepstral coefficients of the sound.

17. A method for controlling an event in accordance with input sounds, comprising the steps of:

analyzing an input sound to determine values for coefficients in a low-dimensional representation of the input sound;

setting values of parameters that relate to a controllable event in accordance with the coefficient values determined for the analyzed input sound; and controlling said event in accordance with said parameter values.

18. The method of claim 17 wherein said controllable event is the generation of a synthesized sound.

19. The method of claim 17 wherein one of said coefficients is a measure of the energy in the input sound, and further including the step of triggering said event to occur when said one coefficient is at least equal to a predetermined threshold value.

20. The method of claim 17 wherein said low-dimensional representation comprises the mel-frequency cepstral coefficients of the sound.

21. A method for generating synthesized sounds that correspond to input sounds, comprising the steps of:

analyzing an input sound to determine values for coefficients for a low dimensional representation of the input sound;

setting values for control parameters that relate to the synthesis of sounds in accordance with the coefficient values determined for the analyzed input sound; and generating a synthesized sound in accordance with said control parameter values.

22. The method of claim 21 wherein said control parameters are MIDI control parameters.

23. The method of claim 22 wherein said MIDI control parameters are selected from the group comprising pressure, embouchure, pitch, vibrato, tonguing, amplitude, breath noise and harmonic enhancement.

24. The method of claim 21 wherein one of said coefficients is a measure of the energy in the input sound, and said generating step is performed when the value of said one coefficient is at least equal to a predetermined threshold value.

25. The method of claim 24 further including the step of controlling the volume of the synthesized sound in accordance with the value of said one coefficient.

26. The method of claim 21 wherein said low-dimensional representation comprises the mel-frequency cepstral coefficients of the sound.

27. A system for generating synthesized sounds, comprising:

an input sound analyzer which determines values for coefficients in a low-dimensional representation of an input sound;

a synthesizer which generates sounds in accordance with values of input control parameters; and a mapping device which applies the determined coefficient values to said input control parameters to control said synthesizer to generate a sound that relates to said input sound.

28. The system of claim 27 wherein said control parameters are MIDI control parameters.

29. The system of claim 28 wherein said MIDI control parameters are selected from the group comprising pressure, embouchure, pitch, vibrato, tonguing, amplitude, breath noise and harmonic enhancement.

30. The system of claim 27 wherein one of said coefficients is a measure of the energy in the input sound, and said mapping device controls said synthesizer to generate said sound when said one coefficient is at least equal to a predetermined threshold value.

31. The system of claim 30 wherein said mapping device further controls the volume of the generated sound in accordance with the value of said one coefficient.

32. The system of claim 27 wherein said low-dimensional representation comprises the mel-frequency cepstral coefficients of the sound.

33. The system of claim 27 wherein said mapping device includes a classifier that defines different classes of sounds that are respectively associated with different regions of a multi-dimensional space that is related to two or more of said coefficients, determines the location of said input sound within said space, in accordance with the determined coefficients, and classifies said input sound based upon its determined location;

wherein said mapping device associates each defined class of sound with a corresponding synthesized sound, and controls said synthesizer to generate the synthesized sound which corresponds to the classification of the input sound.

* * * * *